US006610127B2

(12) United States Patent
Lu

(10) Patent No.: US 6,610,127 B2
(45) Date of Patent: Aug. 26, 2003

(54) FACILITY FOR IMPROVING ENVIRONMENTAL ATMOSPHERE OF INTERIOR SPACE

(76) Inventor: Wen-Pin Lu, 3F, No. 28, Lane 9, Sec. 4, Cheng To Rd., Taipei (TW)

( * ) Notice: Subject to any disclaimer, the term of this patent is extended or adjusted under 35 U.S.C. 154(b) by 0 days.

(21) Appl. No.: 09/906,728

(22) Filed: Jul. 18, 2001

(65) Prior Publication Data

US 2003/0015097 A1 Jan. 23, 2003

(51) Int. Cl.[7] ..... B03C 3/41

(52) U.S. Cl. ..... 96/95; 55/385.2; 96/135; 96/136; 96/153; 106/819; 361/231

(58) Field of Search ..... 96/97, 96, 95, 96/134, 135, 153, 154, 136; 55/385.2, 524; 361/231; 106/819

(56) References Cited

U.S. PATENT DOCUMENTS 3,762,134 A * 10/1973 St. Cyr et al. ..... 55/524 X
4,452,635 A * 6/1984 Noshi et al. ..... 106/628
4,477,263 A * 10/1984 Shaver et al. ..... 96/97 X
5,010,777 A * 4/1991 Yehl et al. ..... 55/385.2 X
5,672,384 A * 9/1997 Kanngard et al. ..... 427/230
5,728,209 A * 3/1998 Bury et al. ..... 106/819
6,126,722 A * 10/2000 Mitchell et al. ..... 361/231 X
6,302,944 B1 * 10/2001 Hoenig ..... 96/97 X

* cited by examiner

*Primary Examiner*—Richard L. Chiesa
(74) *Attorney, Agent, or Firm*—Troxell Law Office PLLC

(57) ABSTRACT

A facility for improving the environmental atmosphere of an interior space, which includes a negative ion discharger; a plurality of electric poles connected to the output wires of the negative ion discharger. The aforementioned negative ion discharger is placed in a corner of the interior space, and the plurality of electric poles are situated in the upper part of the interior space. By means of an active carbon layer beneath the floor indoors, an invisible shelter will be formed by the negative ions released from the negative ion discharger. Accordingly, the ion energy will be effectively decreased, and the particle condition of the indoor space will be harmonized. In addition, a proper proportion of active carbon and zeolite are mixed with concrete, or a predetermined amount of active carbon is buried in cavities by the building, in order to absorb the moisture and the calcium, magnesium, and sodium, to purify the interior atmosphere, to diminish the humidity of the air indoors, and to lift the health of the people living in such space.

10 Claims, 3 Drawing Sheets

FACILITY FOR IMPROVING ENVIRONMENTAL ATMOSPHERE OF INTERIOR SPACE

BACKGROUND OF THE INVENTION

1. Field of the Invention

The present invention relates to a facility for improving the environmental atmosphere of an interior space, and especially to a facility for improving the environmental atmosphere of an interior space which improves the atmosphere of the interior environment, and diminishes the humidity of the indoor space.

2. Description of the Prior Art

As everybody knows, the resource of human body movement is energy For example, our living spaces that relate to the energy of electricity and atmosphere, also closely relate to the human body. Also as we know, one of the essential natural elements in our living spaces is structured by ions with electric charges. For example, NaCl, the main component of salt, is composed of the ion of $Cl^-$ with negative electric charges. Generally, the more ions in the atmosphere, the more negative ions are consumed. So if we could supply sufficient negative ions to the indoor atmosphere, it would be of a great help to improve the indoor atmosphere and interior environment.

On the contrary, if there are less negative ions in the indoor atmosphere, there might be defects such as:

1. The walls of the kitchen and the bathroom might be moldy, especially in rainy seasons.
2. Accordingly, there would be more cockroaches and termites in the room, and the smell of the indoor spaces would stink.
3. In addition, people who live in such space would have more chances to get ill, e.g., if they catch a cold, it is not easy for them to be cured.

In addition, as we know, modern buildings are made of concrete and steel. Generally, the wall made of concrete and steel may absorb moisture from the air, because usually the concrete/cement consists of limestone and clay, mixed with soft wallastonite, shales, pyrite, being ground into powders. The chemical composition of cement is silicic acid 21.60%, aluminite 6.23%, ferric oxide 2.53%, limestone 64.81%, bitter clay 1.63%, sulfate 1.75%, undissolvable dregs 0.67%. However, the wall made of concrete and steel does not completely resist the invasion of moisture.

In order to improve the aforementioned defects from the shortcoming of insufficient interior negative ions, the inventor of the present invention has made a great effort and disclosed many novel designs, eventually this invention of the facility for improving environmental atmosphere of interior space is invented.

SUMMARY OF THE INVENTION

Accordingly, the object of the present invention is to provide a proper proportion of the ions and negative ions of indoor atmospheric environment, that is, to provide a proper concentration of interior negative ions for indoor atmospheric energy.

Another object of the present invention is that since the number of interior negative ions is increased, the energy of the interior atmosphere becomes more stable, so that the walls and the windows of the kitchen and the bathroom may not be moldy, and there won't be cockroaches and termites in the room.

Another object of the present invention is that since the air quality of the interior environment is improved, people living in such a space won't get ill easily, and the immunity of people against diseases may be strengthened. In time, the people living in such a space will be healthier.

Another object of the present invention is that since the interior atmospheric environment is improved and there are less cockroaches and termites in the room, the air quality indoors is purified, and the damage to furniture and other equipment caused by those insects is lessened.

A further object of the present invention is that since the moisture indoors decreases, people who live in such space would have less respiratory problems and their body would be in a better state.

A more complete understanding of these, and other features and advantages of the present invention will become apparent from a careful consideration of the following detailed description of certain embodiments illustrated in the accompanying drawings.

DETAILED DESCRIPTION OF THE PREFERRED EMBODIMENT

Figure 1:
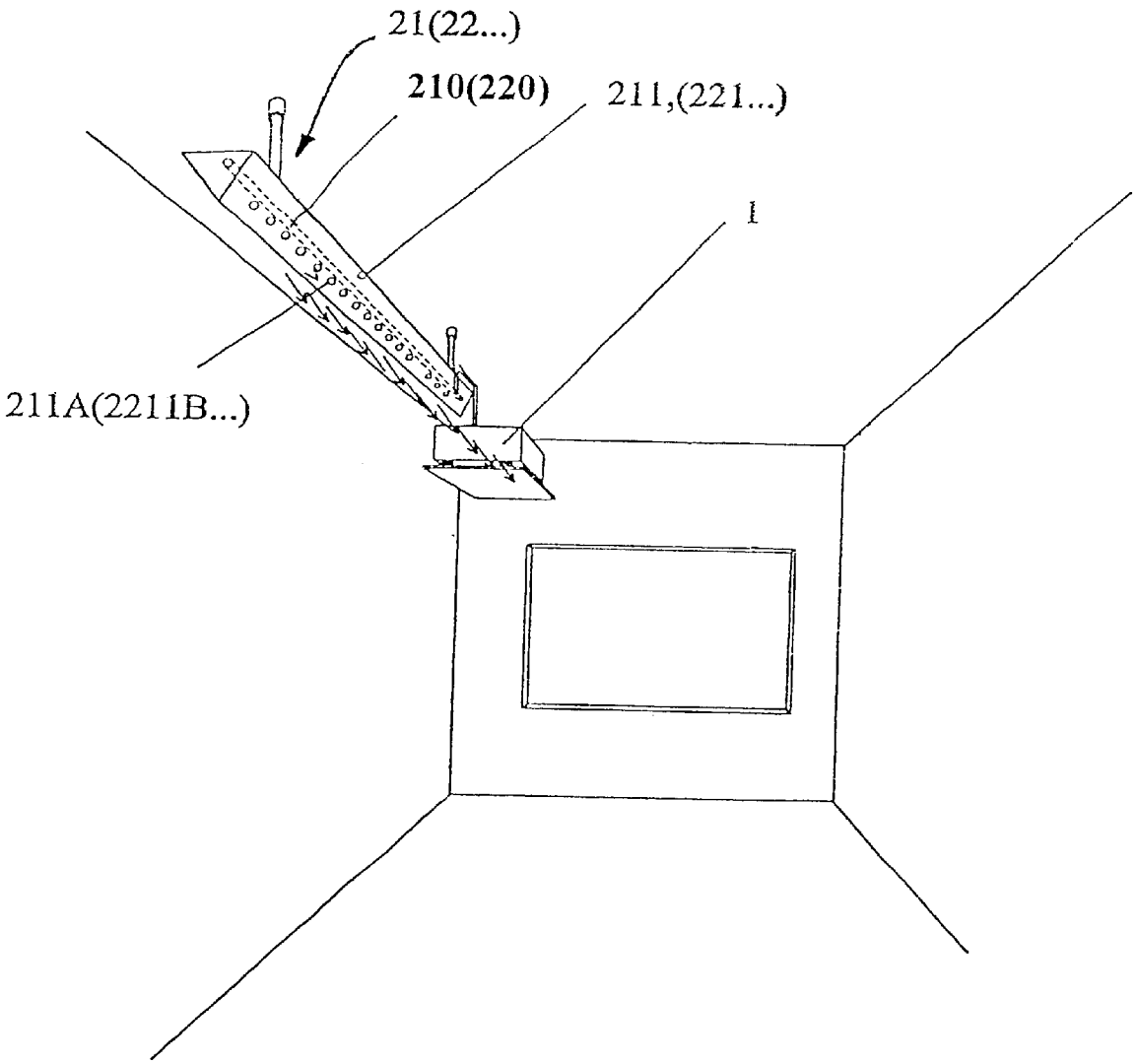
FIG. 1 shows the main structure of the facility of the present invention.

Referring now to FIG. 1, the facility for improving environment atmosphere of interior space of the present invention is composed of an negative ion discharger 1 and a plurality of electric poles 21, 22 . . . , which are connected to the output wires of the negative ion discharger 1. As is shown in FIG. 1, there is a rod 210, 220 . . . on each of the electric poles 21, 22 . . . , each rod is covered by a housing 211, 221 . . . , each housing 211, 221 . . . , is formed with a plurality of small apertures 211A, 211B . . . ; in order to disperse the negative ions from the negative ion discharger 1 into the interior space.

Figure 2:
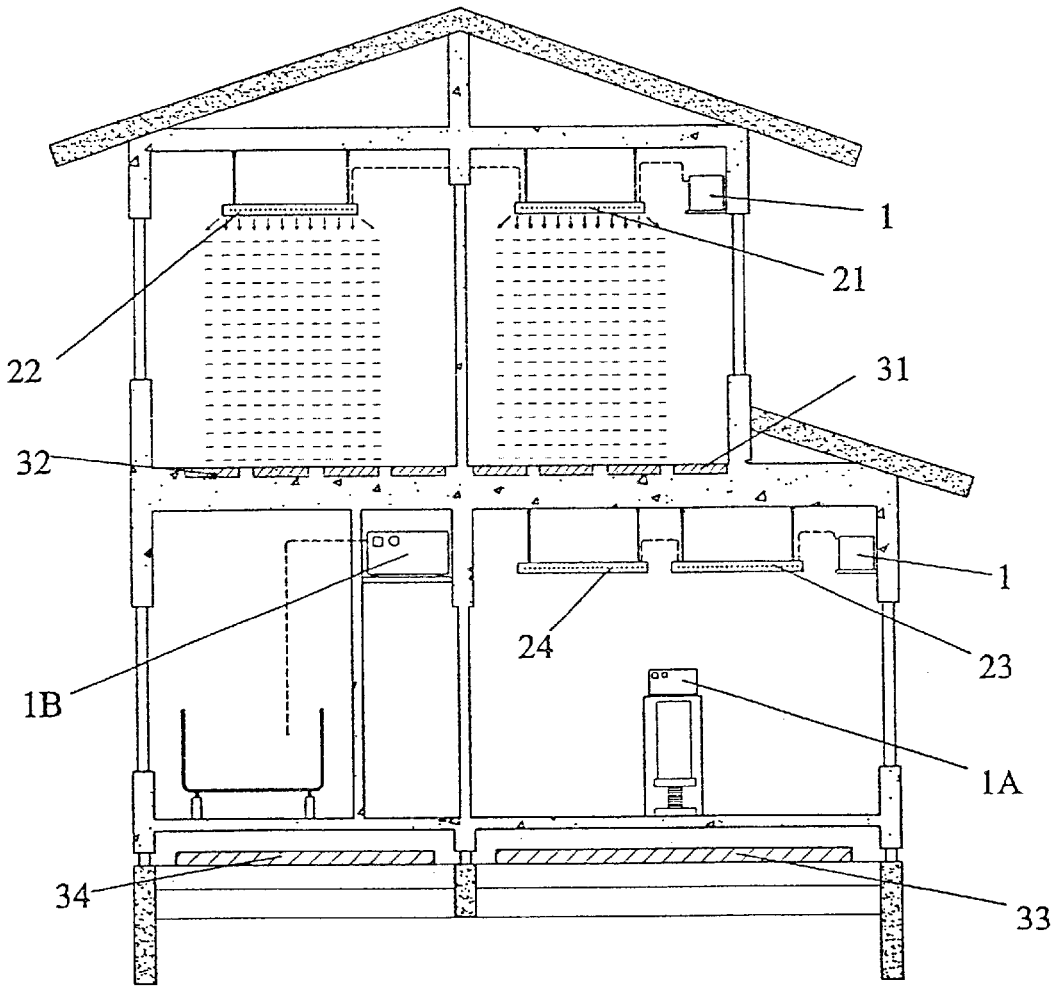
FIG. 2 is an illustration of the first embodiment of the present invention.

Accordingly, as shown in FIG. 2, it is preferably to place the electric poles 21, 22 . . . , in the upper part of the interior space.

The floor inside the interior space is equipped with layers of active carbon 31,32,33,34. For this reason, when the negative ions are released by the electric poles 21, 22 . . . , there will be an invisible shelter of negative ions in order to block pernicious particles from outside according to the performance of the aforementioned layers of active carbon 31,32,33,34.

Figure 3:
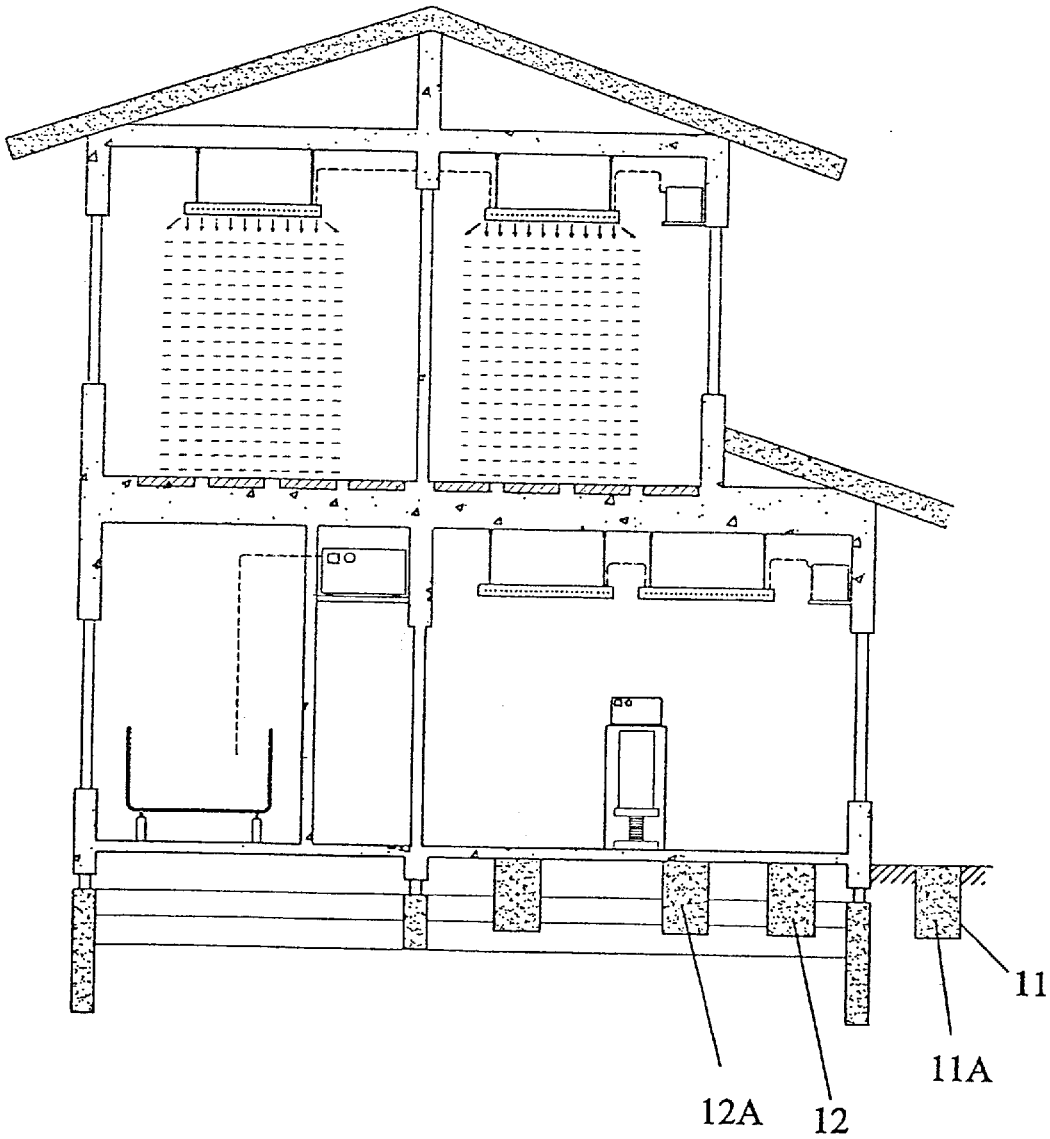
FIG. 3 is an illustration of the second embodiment of the present invention.

In addition, as shown in FIG. 3, there is also a plurality of cavities 11,12 . . . , having one meter of diameter and one meter of depth under the floor. There are also active carbon 11A,12A . . . , placed in these cavities. In this way, the moisture indoors may be absorbed by the aforementioned active carbon. Meanwhile, the soil may be dry, and the energy may increase.

Active carbon and zeolite may also be mixed with cement. The proportion of the active carbon is 12–13 $kg/m^2$ of cement, and the proportion of the zeolite is 20 $kg/m^2$ of cement.

Zeolite($Na_2O.Al_2O_3.2SiO_2.XH_2O$) is made of kaolin (2.5–3.0), melted sodium borate(0–2.4), quartz(0–1.2), aluminum oxide(0–2.0), sodium carbonate(6.5–20.0); and it may be a natural water softener. When the hard water is percolated by zeolite, the calcium and the magnesium in the hard water may be substituted by the sodium in sodium silicone sulfate, so that there will not be calcium and the magnesium in the water, and the water becomes soft water.

When the cement is mixed with zeolite and active carbon, the wall, slab, and the ceiling of the building contain these two elements, and these two elements may absorb the moisture content and calcium and magnesium in the air, so that the air quality of space that people live in will be greatly improved, and the people who live in such space will be in a better health. Also, there will not be enough moisture to harm the furniture and other interior facilities of equipment.

In addition, as shown in FIG. 2, the aforementioned negative ion discharger 1A may also be situated to release negative ions into drinking water. Moreover, it may also be situated to release negative ions into the bathing water when people are taking bath as at 1B.

Accordingly, from the aforementioned description, the facility for interior atmospheric environment improvement of present invention certainly has the effect of improving the atmosphere of the interior environment and diminishing the humidity of the indoor environment without using the artificial energy. It is than an invention worthy for many kinds of applications.

Although the present invention has been described with a certain degree of particularity, the present disclosure has been made by way of example and changes in detail of structure may e made without departing the spirit thereof.

What is claimed is:

1. Apparatus for improving an environmental atmosphere of an interior space comprising:

a) a plurality of first walls bounding a first interior space, including a first floor, the first walls including cement mixed with active carbon and zeolite;

b) a first negative ion discharger located in the interior space;

c) a plurality of first electric pole assemblies connected to the first negative ion discharger, each first electric pole assembly mounted in an upper portion of the first interior space and including an elongated rod enclosed by a housing having a plurality of apertures; and, d) layers of active carbon in the first floor.

2. The apparatus of claim 1 further comprising:

a) a plurality of second walls located below the plurality of first walls, the plurality of second walls bounding a second interior space including a second floor, the second walls including cement mixed with active carbon and zeolite;

b) a second negative ion discharger located in the second interior space;

c) a plurality of second electric pole assemblies connected to the second negative ion discharger, each second electric pole assembly mounted in an upper portion of the second interior space and including an elongated rod enclosed by a housing having a plurality of apertures; and, d) a plurality of active carbon elements located below the second floor.

3. The apparatus of claim 2 wherein the plurality of active carbon elements comprise second layers of active carbon.

4. The apparatus of claim 2 wherein the plurality of active carbon elements are relocated in a plurality of cavities.

5. The apparatus of claim 4 wherein the plurality of active carbon elements are cylindrical in configuration.

6. The apparatus of claim 5 wherein diameters of the active carbon elements are equal to lengths of the active carbon elements.

7. The apparatus of claim 4 further comprising an active carbon element located adjacent to, but externally of the second interior space.

8. The apparatus of claim 1 wherein the active carbon comprises between 12 and 13 $kg/m^2$ of cement.

9. The apparatus of claim 8 wherein the zeolite comprises 20 $kg/m^2$ of cement.

10. The apparatus of claim 1 wherein the zeolite comprises 20 $kg/m^2$ of cement.

* * * * *